US009662772B2

(12) United States Patent
Chen

(10) Patent No.: US 9,662,772 B2
(45) Date of Patent: May 30, 2017

(54) RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 336 days.

(21) Appl. No.: 14/630,655

(22) Filed: Feb. 25, 2015

(65) Prior Publication Data

US 2016/0243680 A1 Aug. 25, 2016

(51) Int. Cl.
*B25B 13/46* (2006.01)

(52) U.S. Cl.
CPC ..... *B25B 13/463* (2013.01)

(58) Field of Classification Search
CPC .... B25B 13/463; B25B 13/461; B25B 13/462
See application file for complete search history.

(56) References Cited

U.S. PATENT DOCUMENTS 6,651,533 B1 * 11/2003 Hsien ..... B25B 13/463 81/124.3
9,327,389 B2 * 5/2016 Chen ..... B25B 13/463 81/60

* cited by examiner

*Primary Examiner* — David B Thomas
(74) *Attorney, Agent, or Firm* — Rosenberg, Klein & Lee

(57) ABSTRACT

A ratchet wrench includes a wrench body, a ratchet wheel and a C-ring. The wrench body has a working end defining a stepped hole. The stepped hole includes an outer large-diameter portion, an inner small-diameter portion and a shoulder disposed at a junction of the large-diameter portion and the small-diameter portion. The ratchet wheel is rotatably mounted in the stepped hole of the wrench body, and has a row of teeth therearound and a flange located proximate to the teeth. The flange rests upon the shoulder of the stepped hole. The C-ring is placed around the ratchet wheel and rests upon an upper surface of the flange of the ratchet wheel. Moreover, the C-ring is configured and sized to be detachably engaged in an annular groove defined in an inner wall of the large-diameter portion of the stepped hole for retaining the ratchet wheel within the stepped hole of the working end of the wrench body.

4 Claims, 9 Drawing Sheets

RATCHET WRENCH

BACKGROUND OF THE INVENTION

1. Field of the Invention

The present invention relates to a ratchet wrench, and more particularly to a ratchet wrench that can be produced in an easily manufactured and assembled manner.

2. Description of the Related Art

As shown in FIGS. 8 and 9, there is shown a conventional ratchet wrench 900 that includes an elongated wrench body 9 having a hole 90 at an end thereof, a chamber 91 in communication with the hole 90, and an annular groove 92 in a sidewall of the hole 90. A ratchet wheel 8 is mounted in the hole 90 of the wrench body 9 for free rotation. The ratchet wheel 8 has a row of teeth 81 therearound and a polygonal hole 82 at a center thereof. A ring member 7 with an outer annular groove 70 is mounted in the hole 90 of the wrench body 9 between the ratchet wheel 8 and the wrench body 9. A C-ring 6 is received in both of the annular groove 70 of the ring member 7 and the annular groove 92 of the wrench body 9 to restrain the ratchet wheel 8 in the hole 90 but still leaves the ratchet wheel 8 for free rotation.

As best seen in FIG. 9, it is unfortunate however that once the C-ring 6 is assembled into both of the annular grooves 70, 92 of the ring member 7 and the wrench body 9, the C-ring 6 will be trapped therebetween, and the ratchet wheel 8 will be permanently sealed in the hole 90 of the wrench body 9. That is, the C-ring 6 cannot further be released from the annular grooves 70 and 92, without damage of the wrench. Thus, if any interior parts of the ratchet wrench is broken, there is no change to repair the parts.

SUMMARY OF THE INVENTION

Accordingly, it is an object of the present invention to provide a new ratchet wrench to solve the aforementioned problem.

It is another object of the present invention to provide a ratchet wrench that can be produced in an easily manufactured and assembled manner.

Briefly described, the ratchet wrench of this invention includes a wrench body, a ratchet wheel and a C-ring. The wrench body has a working end defining a stepped hole. The stepped hole includes an outer large-diameter portion, an inner small-diameter portion and a shoulder disposed at a junction of the outer large-diameter portion and the inner small-diameter portion. The working end further defines an annular groove in an inner wall of the outer large-diameter portion of the stepped hole. The ratchet wheel is rotatably mounted in the stepped hole of the wrench body, and has a row of teeth therearound and a flange located proximate to the teeth. The flange rests upon the shoulder of the stepped hole of the working end of the wrench body. The C-ring is placed around the ratchet wheel and rests upon an upper surface of the flange of the ratchet wheel. Moreover, the C-ring is configured and sized to be detachably engaged in the annular groove in the inner wall of the outer large-diameter portion of the stepped hole for retaining the ratchet wheel within the stepped hole of the working end of the wrench body.

It is preferred that the C-ring is a flat, thin piece with a cutout to form two opposed end portions, and the C-ring is partly inserted in the annular groove in the working end of the wrench body.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
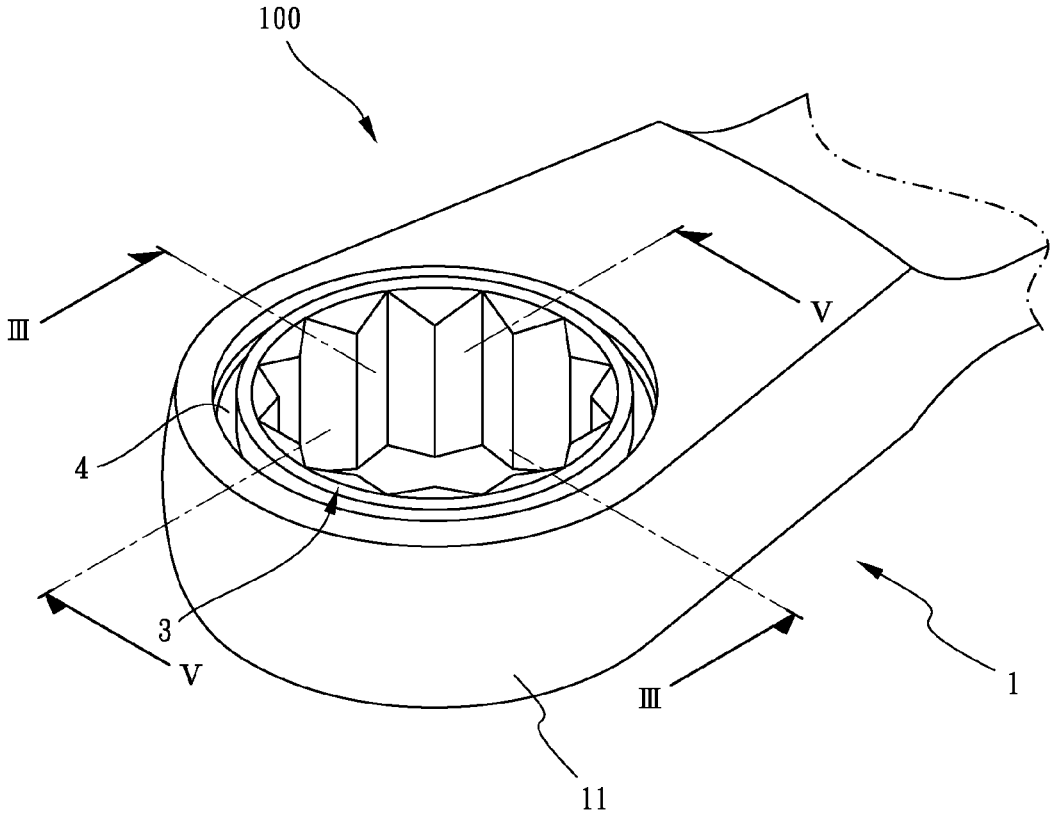
FIG. 1 is a perspective view of a ratchet wheel in accordance with the preferred embodiment of the present invention.
Figure 2:
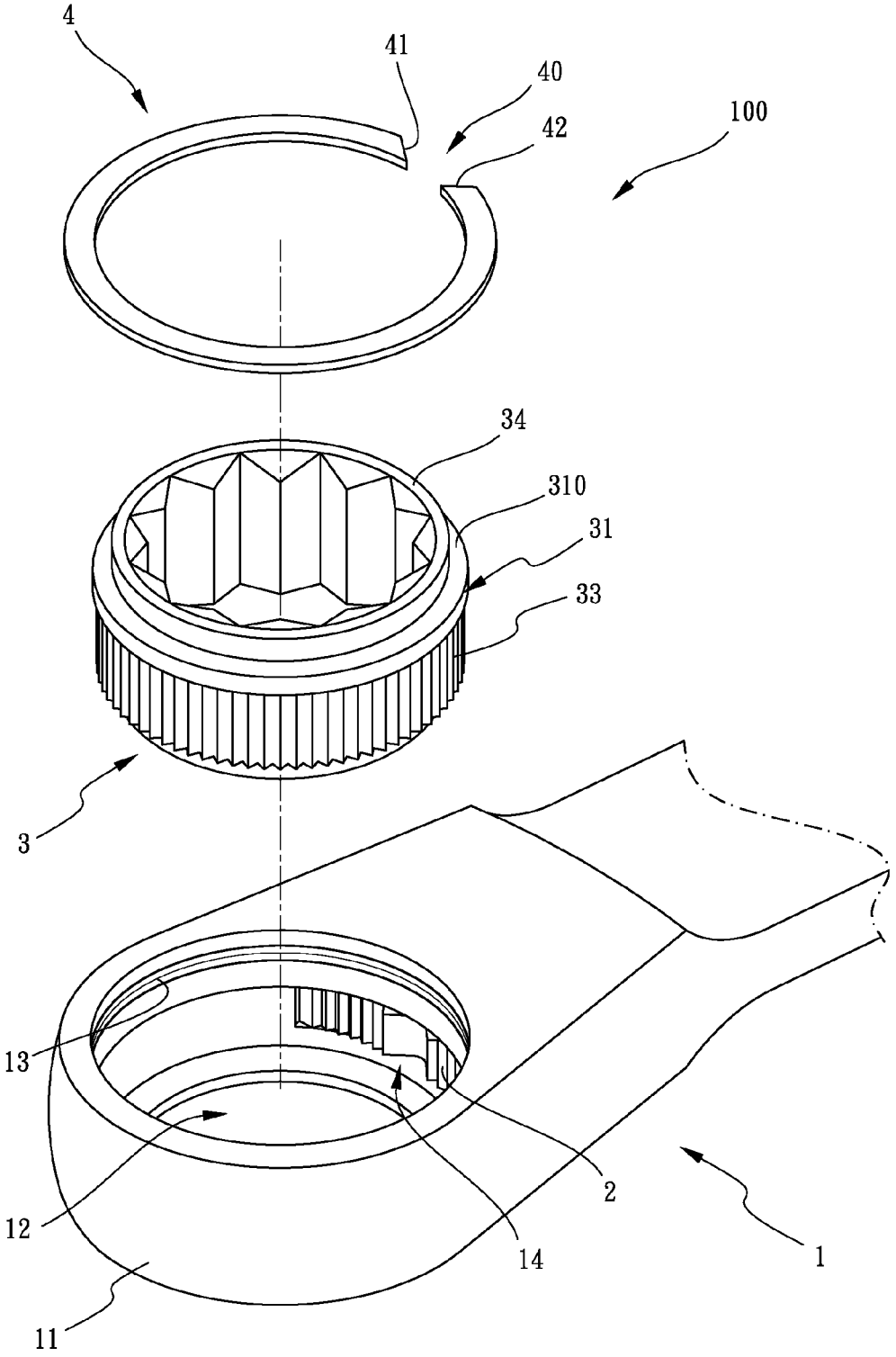
FIG. 2 is an exploded perspective view of the ratchet wheel shown in FIG. 1.

Referring now to the drawings for a more detailed description of the present invention and more particularly to FIGS. 1 and 2, a novel ratchet wrench made according thereto is generally indicated by the reference numeral 100. The ratchet wrench 100 as shown includes a wrench body 1, a ratchet wheel 3 disposed in the wrench body 1 and a C-ring 4 for retaining the ratchet wheel 3 within the wrench body 1.

Figure 3:
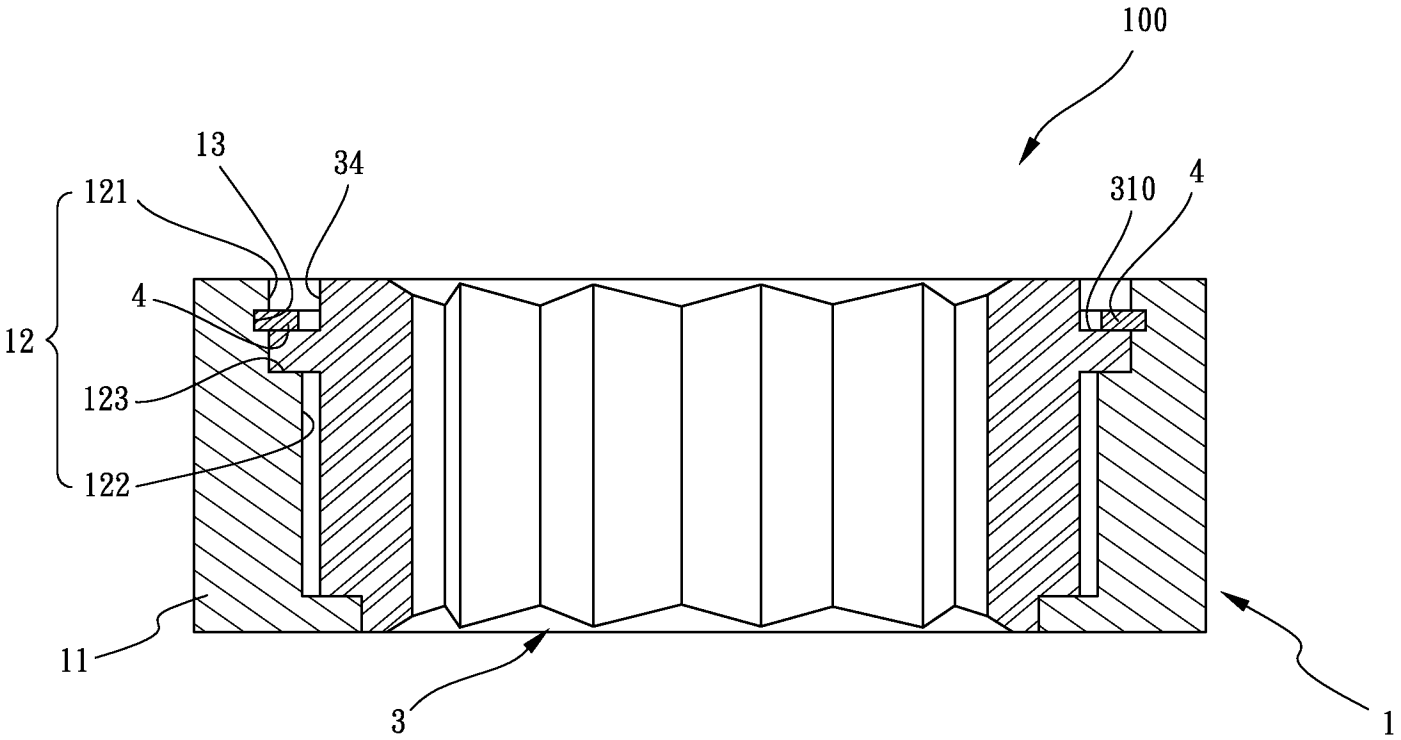
FIG. 3 is a cross-sectional view of the ratchet wrench shown in FIG. 1, taken along the line III-III.

As shown in FIG. 2, the wrench body 1 has a working end 11 and a handle portion (not shown) opposite the working end 11. The working end 11 defines a stepped hole 12 at a center thereof for reception of the ratchet wheel 3. As shown in FIG. 3, the stepped hole 12 of the working end 11 includes an outer, large-diameter portion 121, an inner, small-diameter portion 122 and a shoulder 123 disposed at the junction of the outer large-diameter portion 121 and the inner small-diameter portion 122. Furthermore, the working end 11 defines an annular groove 13 in an inner wall of the outer large-diameter portion 121 of the stepped hole 12.

Figure 4:
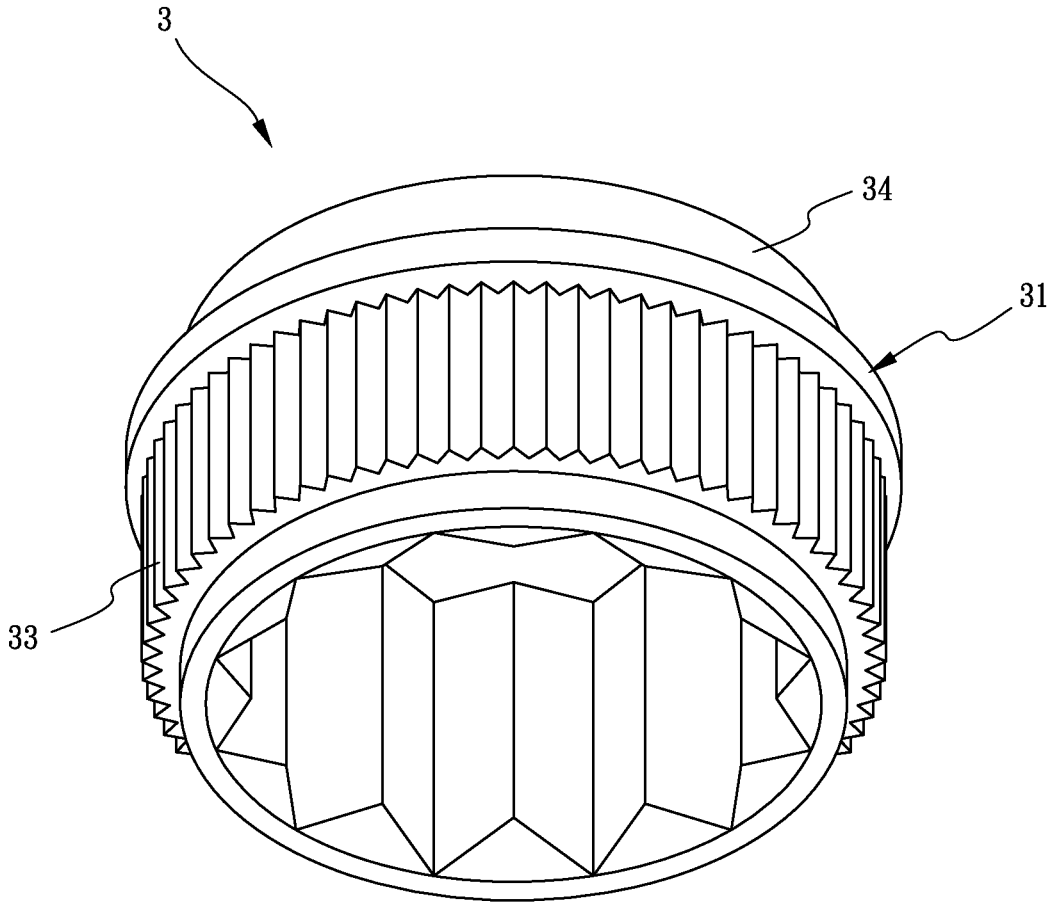
FIG. 4 is an enlarged perspective view of a ratchet wheel of the ratchet wrench shown in FIG. 2, taken from another angle.

Referring back to FIG. 2, the ratchet wheel 3 is rotatably mounted in the stepped hole 12 of the wrench body 1. Specifically, the ratchet wheel 3 has a row of teeth 33 therearound and a flange 31 located proximate to the teeth 33, and an upper edge 34 opposite the teeth 33, as best seen in FIG. 4. As shown in FIG. 3, the flange 31 of the ratchet wheel 3 rests upon the shoulder 123 of the stepped hole 12 of the working end 11 of the wrench body 1.

Figure 6:
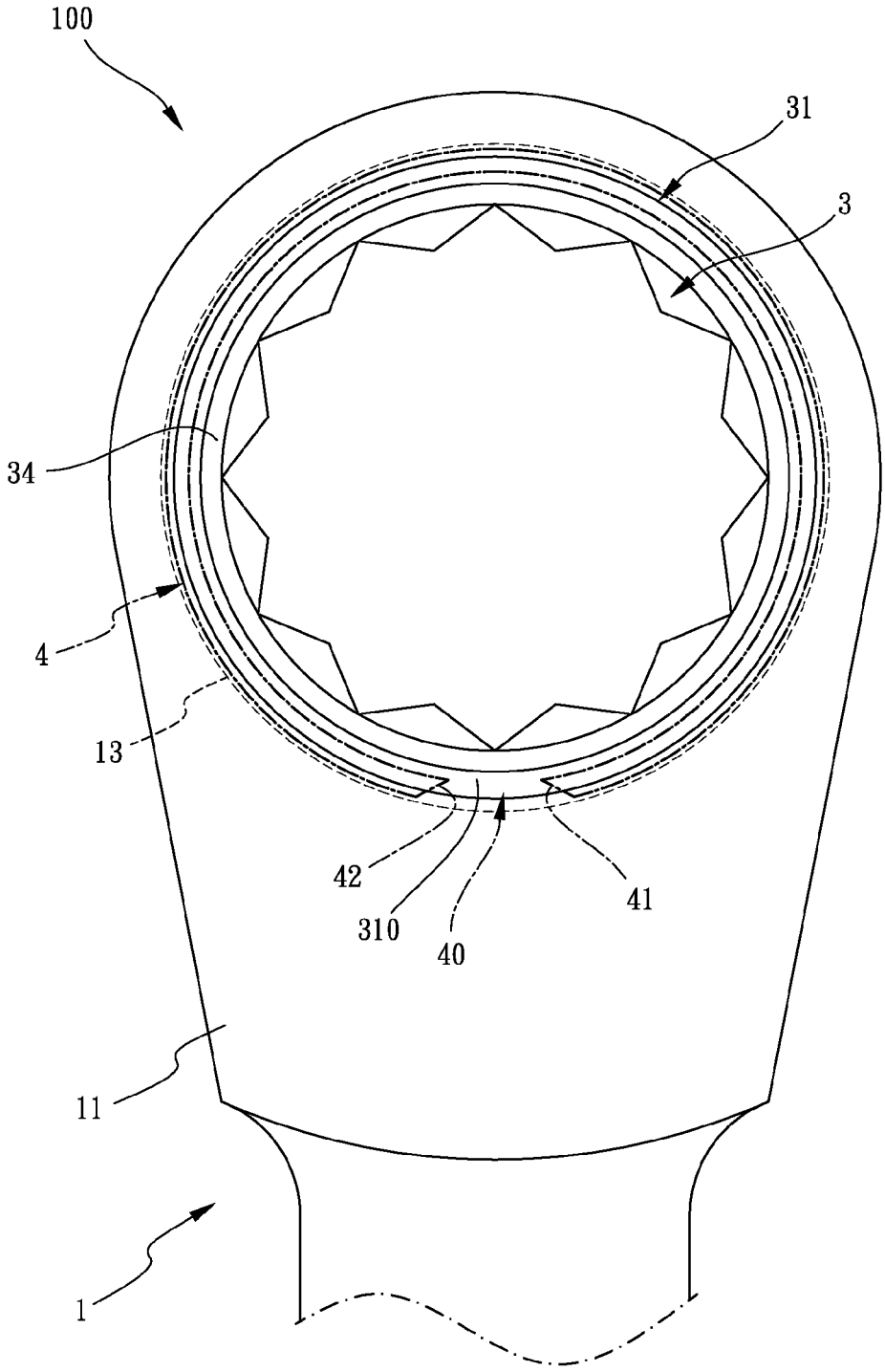
FIG. 6 is a partially, enlarged top view of the ratchet wrench shown in FIG. 1, with the C-ring positioned in its locking position.

With reference to FIGS. 2 and 3, the C-ring 4 is placed around the ratchet wheel 3. Moreover, the C-ring 4 is configured and sized to be detachably engaged in the annular groove 13 in the inner wall of the outer large-diameter portion 121 of the stepped hole 12 for retaining the ratchet wheel 3 within the stepped hole 12. In the illustrated embodiment, the C-ring 4 is a flat, thin piece with a cutout 40 to form two opposed end portions 41, 42. The C-ring 4 rests upon an upper surface 32 of the flange 31 of the ratchet wheel 3 and is partly inserted in the annular groove 13 in the working end 11 of the wrench body 1, as depicted in FIG. 6. In particular, each of the end portions 41, 42 of the C-ring 4 is beveled in a manner that the cutout 40 between the end portions 41, 42 is tapered toward the center of the ratchet wheel 3.

Figure 5:
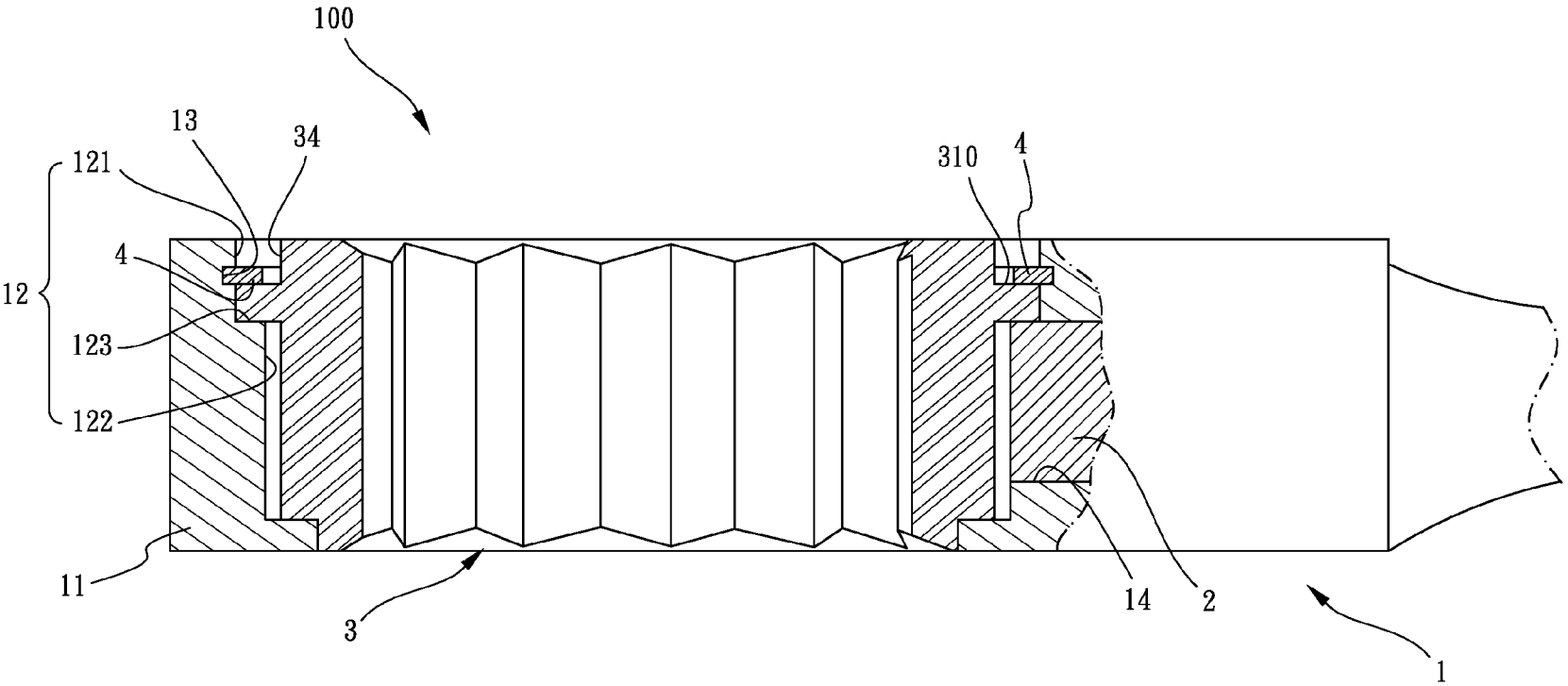
FIG. 5 is a cross-sectional view of the ratchet wrench shown in FIG. 1, taken along the line V-V.

As shown in FIGS. 2 and 5, the ratchet wrench 100 further includes at least one pawl 2 that is received in a chamber 14 defined in an inner wall of the inner small-diameter portion 122 of the stepped hole 12. The pawl 2 selectively meshes with the teeth 31 of the ratchet wheel 3, as in a known manner.

Figure 7:
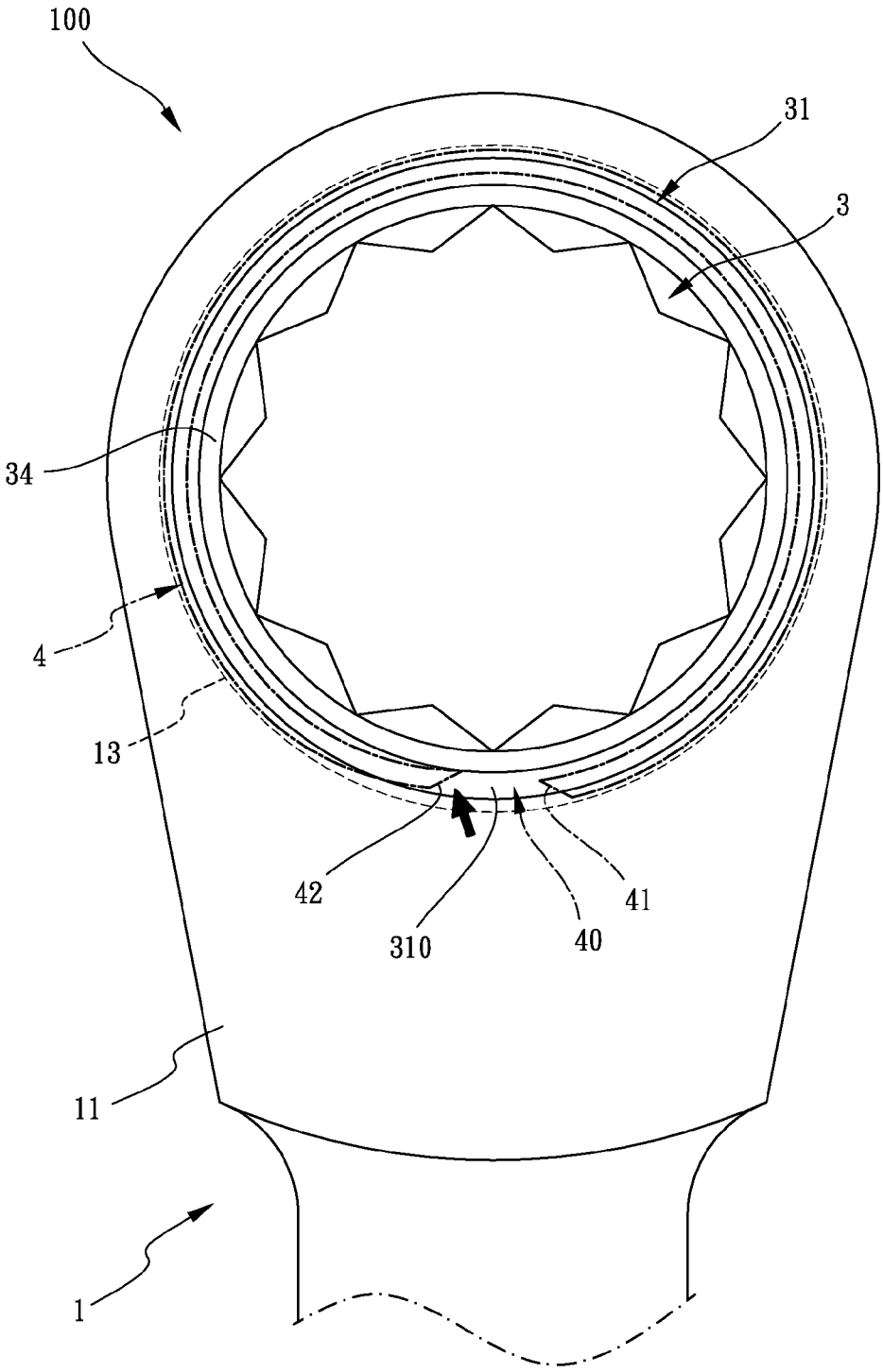
FIG. 7 is a view similar to FIG. 6, with the C-ring being pushed to be removed.
Figure 8:
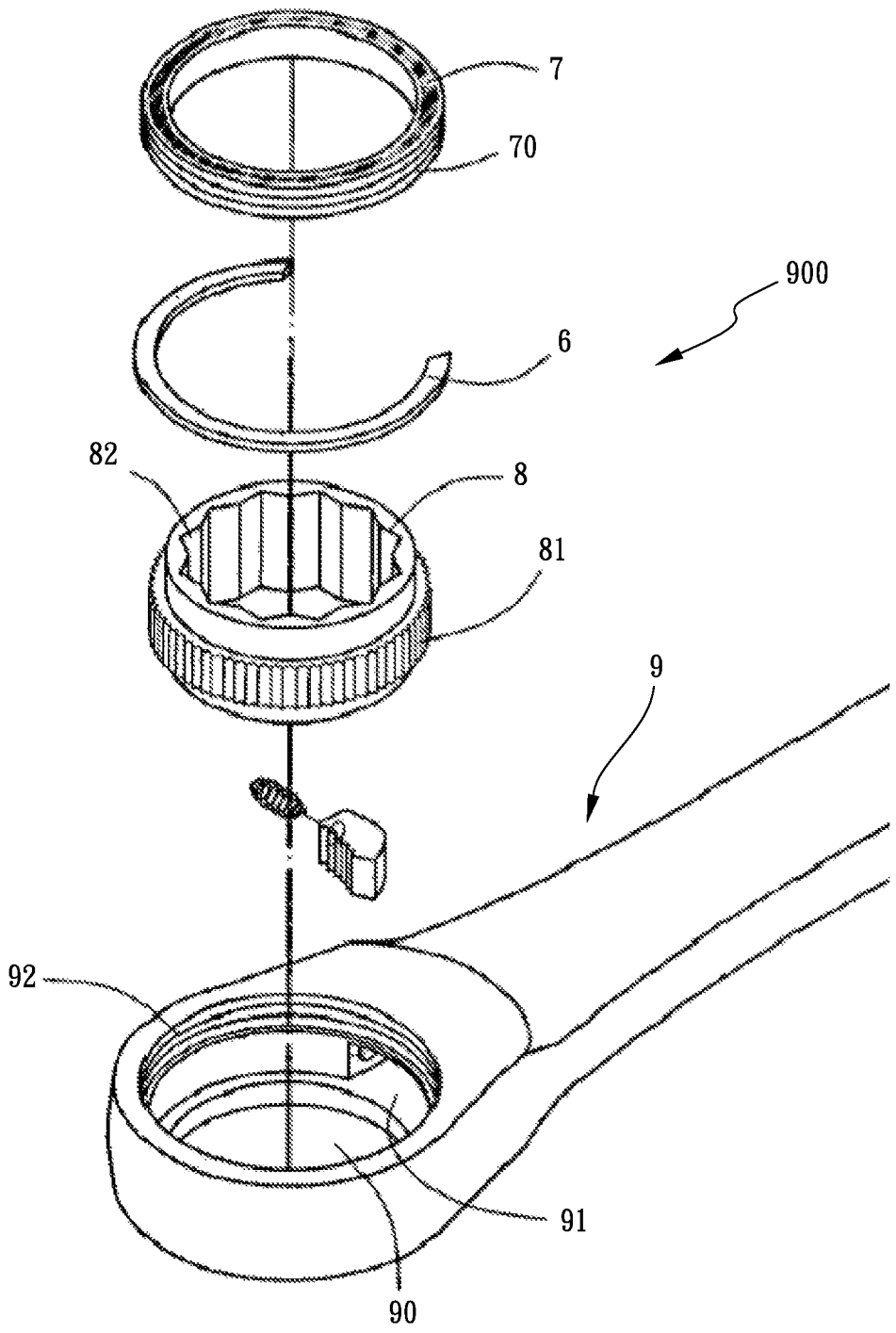
FIG.8 (Prior art)
FIG. 8 is an exploded perspective view of a prior art ratchet wrench.
Figure 9:
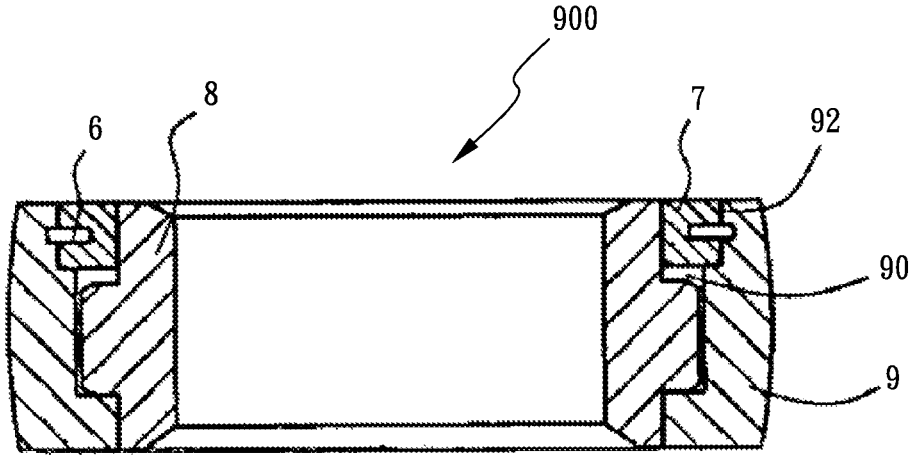
FIG.9 (Prior art)
FIG. 9 is a cross section of the prior art ratchet wrench of FIG. 8.

Unlike the prior art of FIG. 8 or 9, the user may dismantle the ratchet wrench 100 in order to repair it, if necessary. Referring to FIG. 6, to remove the C-ring 4 from the stepped hole 12 of the working end 11 of the wrench body 1, a user may use a hand tool, such as a flat-blade screwdriver, to push one of the beveled end portions 41, 42 of the C-ring 4 out of the annular groove 13 of the working end 11 of the wrench body 1, as indicated by the arrow in FIG. 7, to facilitate drawing of the C-ring 4 completely out of the annular groove 13. Upon removal of the C-ring 4 out of the stepped hole 12, the ratchet wheel 3, as well as the pawl 2, is exposed in the stepped hole 12 and ready to be taken out for repair.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A ratchet wrench, comprising:

a wrench body having a working end defining a stepped hole that includes an outer large-diameter portion, an inner small-diameter portion and a shoulder disposed at a junction of the outer large-diameter portion and the inner small-diameter portion, wherein the working end further defines an annular groove in an inner wall of the outer large-diameter portion of the stepped hole;

a ratchet wheel rotatably mounted in the stepped hole of the wrench body, and having a row of teeth therearound and a flange located proximate to the teeth, wherein the flange rests upon the shoulder of the stepped hole of the working end of the wrench body; and a C-ring placed around the ratchet wheel, resting upon an upper surface of the flange of the ratchet wheel, and configured and sized to be detachably engaged in the annular groove in the inner wall of the outer large-diameter portion of the stepped hole for retaining the ratchet wheel within the stepped hole of the working end of the wrench body.

2. A ratchet wrench as recited in claim 1, wherein the C-ring is a flat, thin piece with a cutout to form two opposed end portions, and the C-ring is partly inserted in the annular groove in the working end of the wrench body.

3. A ratchet wrench as recited in claim 2, wherein each of the end portions of the C-ring is beveled in a manner that the cutout between the end portions is tapered toward a center of the ratchet wheel.

4. A ratchet wrench as recited in claim 1, further comprising at least one pawl that is received in a chamber defined in an inner wall of the inner small-diameter portion and meshes with the teeth of the ratchet wheel.

* * * * *